US011484810B2

(12) United States Patent
Faivre et al.

(10) Patent No.: US 11,484,810 B2
(45) Date of Patent: Nov. 1, 2022

(54) ACCESSORY OF LIGHT-SABRE TYPE

(71) Applicant: GROUPE LDLC, Limonest (FR)

(72) Inventors: Laurent Faivre, Ecully (FR); Jasmine Marchetti, Chaleins (FR)

(73) Assignee: GROUPE LDLC, Limonest (FR)

( * ) Notice: Subject to any disclaimer, the term of this patent is extended or adjusted under 35 U.S.C. 154(b) by 0 days.

(21) Appl. No.: 17/281,313

(22) PCT Filed: Sep. 26, 2019

(86) PCT No.: PCT/FR2019/052289
§ 371 (c)(1),
(2) Date: Mar. 30, 2021

(87) PCT Pub. No.: WO2020/070415
PCT Pub. Date: Apr. 9, 2020

(65) Prior Publication Data

US 2022/0001291 A1 Jan. 6, 2022

(30) Foreign Application Priority Data

Oct. 3, 2018 (FR) ..... 18 59193

(51) Int. Cl.
*A63H 33/30* (2006.01)
*A63H 33/00* (2006.01)
*A63H 33/22* (2006.01)

(52) U.S. Cl.
CPC ..... *A63H 33/009* (2013.01); *A63H 33/22* (2013.01)

(58) Field of Classification Search
CPC ..... A63H 33/009; A63H 33/22
See application file for complete search history.

(56) References Cited

U.S. PATENT DOCUMENTS 4,208,701 A * 6/1980 Schock ..... F21L 2/00 362/202
4,231,077 A 10/1980 Joyce et al.
4,678,450 A * 7/1987 Scolari ..... A63H 33/009 362/202
4,877,270 A * 10/1989 Phillips ..... F16L 49/06 285/911
5,165,781 A * 11/1992 Orak ..... G09F 19/12 362/186

(Continued)

FOREIGN PATENT DOCUMENTS

WO 93/10872 6/1993

*Primary Examiner* — Eugene L Kim
*Assistant Examiner* — Matthew B Stanczak
(74) *Attorney, Agent, or Firm* — Clark & Brody LP

(57) ABSTRACT

A light-sabre type accessory comprises a tubular blade including a tube with a proximal end and a distal end. The accessory also includes a handle having a sleeve with first and second ends, into which is inserted a control unit controlling at least one lighting source lighting the tubular blade. A system for removably fixing the tubular blade on the handle through its proximal end includes a mouthpiece fitted to the proximal end of the tube and a clamping ring engaged to be fitted onto the mouthpiece and fixed to the first end of the sleeve. The mouthpiece also includes a shoulder able to abut against the first end of the sleeve and the sleeve includes, from its first end, a well in which the mouthpiece is engaged up to its shoulder, the clamping ring being engaged from the distal end of the tube to be fitted onto the mouthpiece.

14 Claims, 4 Drawing Sheets

(56) References Cited

U.S. PATENT DOCUMENTS 5,279,513 A * 1/1994 Connelly ..... A63H 33/009 446/485
5,321,591 A * 6/1994 Cimock ..... H03K 3/2828 362/186
5,947,789 A * 9/1999 Chan ..... A63H 33/009 446/485
6,030,272 A * 2/2000 Hu ..... A63H 33/009 446/233
6,036,576 A 3/2000 Colon, Jr.
6,082,876 A * 7/2000 Hanson ..... F21L 15/04 362/186
9,579,587 B1 * 2/2017 Chen ..... A63H 33/009
10,065,127 B1 * 9/2018 Honeck ..... A63H 33/26
2001/0024973 A1 * 9/2001 Meredith ..... A63F 13/428 463/36
2007/0111636 A1 * 5/2007 Hatherley ..... A63H 33/009 446/473
2007/0197128 A1 * 8/2007 Reinhardt ..... A63H 5/00 446/473
2007/0270077 A1 * 11/2007 Woodhouse ..... A63H 33/009 446/473
2008/0051002 A1 * 2/2008 Chung Wong ..... F41B 11/641 446/473
2008/0051003 A1 * 2/2008 Hom ..... A63H 33/22 446/485
2008/0220693 A1 * 9/2008 Cuisinier ..... A63H 33/009 463/43
2009/0149255 A1 * 6/2009 Fu ..... A63F 13/02 463/36
2010/0048097 A1 * 2/2010 Ma ..... F21S 4/22 446/485
2011/0109453 A1 * 5/2011 Chen ..... G04F 1/005 340/540
2013/0069874 A1 * 3/2013 Kamentser ..... G06F 3/0338 345/161
2014/0342634 A1 11/2014 Richins
2015/0126260 A1 * 5/2015 Lynch ..... A63H 33/009 463/8
2015/0314213 A1 * 11/2015 Zhou ..... A63H 33/22 446/485
2015/0375100 A1 * 12/2015 Kaye ..... A63F 9/24 273/454
2016/0008730 A1 * 1/2016 Stubenfoll ..... A63H 33/22 446/170
2017/0182405 A1 * 6/2017 Holmes ..... A63F 13/211
2017/0203225 A1 7/2017 Goslin
2018/0353845 A1 * 12/2018 Fischer ..... A63F 9/24
2019/0022542 A1 * 1/2019 Graves ..... F21V 14/00
2019/0232183 A1 * 8/2019 Siddeeq ..... A63H 33/009
2019/0282873 A1 * 9/2019 King, II ..... A63H 33/22
2019/0291017 A1 * 9/2019 Yohannes ..... A63H 33/26
2020/0353374 A1 * 11/2020 Kaye ..... A63H 27/10
2022/0001291 A1 * 1/2022 Faivre ..... A63H 33/22

* cited by examiner

ACCESSORY OF LIGHT-SABRE TYPE

The present invention concerns an accessory of light-sabre type.

Some fictional characters use an accessory called "light-sabre" as their weapon of choice, which comprises a luminous blade and a handle. A light-sabre is wielded like a conventional sabre, but emits light and/or sounds during combat.

Many light-sabre type accessories have been marketed, whether for playing purposes, for artistic performances or for collection purposes. These accessories are usually formed of a cylindrical-shaped handle on which a tubular blade is mounted. One or more LED(s) emit light so as to illuminate the tubular blade.

A first problem associated with these light-sabre type accessories is the large space requirement of the tubular blade, which makes it difficult to transport the light-sabre type accessories. It is therefore preferable to be able to mount and dismount the tubular blade on the handle. Usually, the tubular blade is fixed using one or more screw(s) which block(s) the tubular blade on the handle. This fixing means requires the use of tools to ensure the mounting and dismounting. In addition, due to the positioning of the screws, the mounting and dismounting of the tubular blade on the handle is complex. In addition, holding in position the tubular blade on the handle depends on the quality of the fixing system and, sometimes, may be insufficient in the event of impact in particular.

In the state of the art, it is also known from the U.S. Pat. No. 4,231,077 a light-sabre type accessory including a handle on which is fixed by means of a clamping ring, a mouthpiece on which a tubular blade is fitted by deformation. As a result, this blade may detach from the handle during the use of the accessory. In addition, this mounting does not allow rigid holding of the tubular blade.

In this context, a first embodiment of the invention aims at solving these drawbacks of the prior art. Particularly, the first embodiment of the invention proposes a light-sabre type accessory comprising a system for removably fixing the tubular blade on the handle allowing, not only, easy mounting and dismounting, but also robust fixing of the tubular blade to the handle. To this end, the light-sabre type accessory according to this first embodiment of the invention comprises:

- a tubular blade comprising a tube including a proximal end and a distal end;
- a handle comprising a sleeve with a first end and a second end, into which is inserted a control unit controlling at least one lighting source lighting the tubular blade;
- a system for removably fixing the tubular blade on the handle through its proximal end, composed of a mouthpiece fitted to the proximal end of the tube and a clamping ring engaged to be fitted onto the mouthpiece and fixed to the first end of the sleeve.

According to the invention, the mouthpiece is fixed on the outside of the tube and includes a shoulder able to abut against the first end of the sleeve and the sleeve includes from its first end, a well in which the mouthpiece is engaged up to its shoulder, the clamping ring being engaged from the distal end of the tube to be fitted onto the mouthpiece.

The accessory according to the first embodiment of the invention has advantageously either of these characteristics, alone or in combination:

- the mouthpiece includes at its free end an abutment bottom for the tube extended at right angle by a return inserted inside the tube, allowing holding in position the tube;
- the return of the mouthpiece ensures the holding of a light diffusion and conduction system inserted inside the tube;
- the clamping ring includes a protruding portion relative to the sleeve whose profile is formed to serve as a blade guard.

A second problem associated with the light-sabres of the prior art concerns the mounting in the handle of the electronic system for illuminating the tubular blade and/or emitting sounds based on the detected movements and on the impacts experienced by the light-sabre. Indeed, in the prior art, the LED(s) is/are lit by the application of a pressure on a button placed in protrusion from the handle. Usually, this button is connected to an electronic system by electric wires. The sounds are conventionally emitted by means of a loudspeaker placed in the handle and also connected to the electronic system by electric wires. Also, the mounting of the electronic system in the handle can be complex. In addition, it is important that this electronic system does not move in the handle so that it is not damaged in the event of impact. Finally, cells allow powering the electronic system. It is therefore preferable to reduce the space requirement of the electronic system in the handle, in order to be able to increase the capacity of the cells and thus improve the battery life of the light-sabres.

In this context, a second embodiment of the invention aims at overcoming these drawbacks of the prior art. Particularly, the second embodiment of the invention proposes a light-sabre type accessory in which a handle comprises a control unit allowing a holding in position of the electronic system, preferably in a small space, as well as an easy mounting. To this end, the light-sabre type accessory according to this second embodiment of the invention comprises:

- a tubular blade comprising a tube including a proximal end and a distal end;
- a handle comprising a sleeve with a first end and a second end, into which is inserted a control unit controlling at least one lighting source lighting the tubular blade, the control unit comprising a cylindrical support cooperating with the inner surface of the sleeve, the cylindrical support holding in position an electronic system provided with a control button controlling the lighting source, said control button being guided in translation by the cylindrical support and positioned facing an orifice formed in the sleeve.

The accessory according to the second embodiment of the invention has advantageously either of these characteristics, alone or in combination:

- the light-sabre type accessory comprises a system for blocking in translation and in rotation the cylindrical support in the sleeve;
- the cylindrical support is composed of a casing provided with an assembly structure to hold in position the electronic system, and from which extends a tubular shank internally delimiting a receiving housing, open at the end opposite to the casing, to receive cells;
- a knob is fixed to the second end of the sleeve, the knob comprising a loudspeaker and an electronic board supporting a control circuit controlling the loudspeaker;
- the electronic system is equipped with a gyroscope and an accelerometer to detect movements of the handle, the control button being connected to a control circuit controlling the lighting source to activate the lighting source based on the detected movements;

the electronic system is in the form of several electronic boards mounted in a superimposed manner;

the light-sabre type accessory includes an electric power supply circuit comprising a connection strip carried by the outside of the shank and extending from one end to the other of the control unit, a terminal at the bottom of the housing of the shank and a circular terminal at the opposite end, to establish an electrical contact with the cells; and the control button controls the operation of the loudspeaker.

In addition, it would be advantageous to be able to emit the sound on an audio peripheral, such as a speaker or a headset, based on the movements and impacts experienced by the light-sabre type accessory. It would also be advantageous to be able to modify the nature of the sounds emitted and/or the color diffused in the blade according to the wishes of the user, for example via an application on a smartphone or a tablet.

In this context, a third embodiment of the invention proposes a light-sabre type accessory including a Bluetooth emitter component allowing communication with a remotely communicating device. To this end, the light-sabre type accessory according to this third embodiment of the invention comprises:

a tubular blade comprising a tube including a proximal end and a distal end, a handle comprising a sleeve with a first end and a second end, into which is inserted a control unit controlling at least one lighting source lighting the tubular blade, the control unit comprising an electronic system including a Bluetooth emitter component allowing communication with a remotely communicating device.

The accessory according to this third embodiment of the invention has advantageously either of these characteristics, alone or in combination:

an aperture is formed in the sleeve facing the Bluetooth emitter component to promote the passage of waves;

the electronic system is in the form of several electronic boards mounted in a superimposed manner;

the electronic system includes an electronic motherboard equipped with a gyroscope and an accelerometer, fixed by snap-fastening to the cylindrical support, on one side supporting a connector assembled with a complementary connector carried by another electronic board supporting the control button, and on the other side assembled by snap-fastening to an electronic board including the Bluetooth emitter component.

Various other characteristics emerge from the description given below with reference to the appended drawings which show, by way of non-limiting examples, embodiments of the object of the invention.

As illustrated in the Figures, the invention concerns a light-sabre type accessory 1 comprising a tubular blade 2 fixed on a handle 3 and comprising at least one lighting source 4.

Whatever the embodiment, the light-sabre type accessory 1 includes at least one lighting source 4, positioned either in the handle 3 or along the tubular blade 2. As an example of lighting sources suitable in the framework of the invention, mention may be made of the LEDs which are commonly used in the field.

Figure 1:
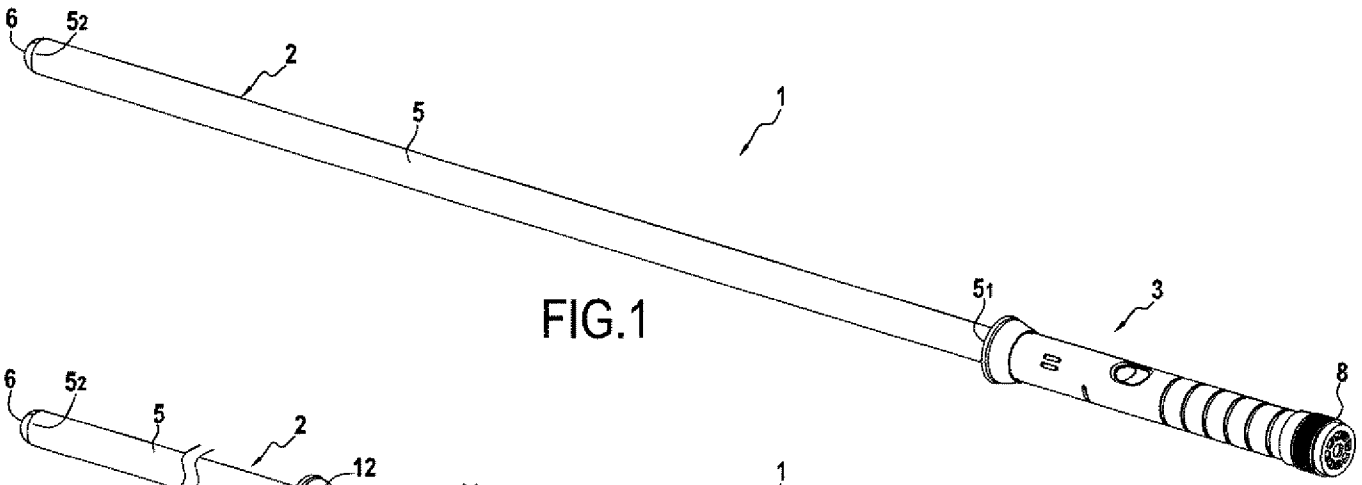
FIG. 1 is a perspective view of a light-sabre type accessory according to the invention.

Whatever the embodiment, the tubular blade 2 comprises a tube 5, including a proximal end $\mathbf{5}_1$ and a distal end $\mathbf{5}_2$ (FIG. 1).

Preferably, the tube 5 is translucent or even transparent. Alternatively, the tube 5 can be loaded with diffusing dye/dies.

Advantageously, the tube 5 has a thickness comprised between 2 mm and 3 mm.

For example, the tube 5 can be made of polycarbonate. Indeed, polycarbonate has the advantage of being mechanically resistant, of absorbing UV rays, of being easy to extrude and of being light.

According to a particular embodiment, the tube 5 is made of polycarbonate and has a thickness comprised between 2 mm and 3 mm.

Whatever the embodiment, the tubular blade 2 also comprises a closure plug 6 fixed to the distal end $\mathbf{5}_2$ of the tube 5. The tube 5 is then closed at its distal end $\mathbf{5}_2$ by said closure plug 6. Preferably, the closure plug 6 is made similarly to the tube 5 (that is to say same material).

Whatever the embodiment, the tubular blade 2 of the light-sabre type accessory 1 according to the invention can advantageously be illuminated by the lighting source(s) 4, preferably based on the movements of said accessory. In this case, the tube 5 preferably comprises a light diffusion and conduction system so that the light is uniform right through the tubular blade 2. As examples of a conduction and diffusion system, mention may be made of the plastic films which can in particular be positioned on the inner wall $\mathbf{5}_3$ of the tube 5. Any light conduction and diffusion system known in the state of the art may be suitable in the framework of the invention.

Whatever the embodiment of the invention, the light-sabre type accessory 1 according to the invention has a handle 3 comprising a sleeve 7, having a first end $\mathbf{7}_1$ and a second end $\mathbf{7}_2$. As illustrated in FIG. 1, the sleeve 7 may have a cylindrical shape and include grooves. This example is not limiting, and other forms of sleeve may be suitable in the framework of the invention. The sleeve 7 can be perforated.

Advantageously, whatever the embodiment of the invention, the handle 3 also comprises a knob 8 fixed to the second end $\mathbf{7}_2$ of the sleeve 7. The knob 8 can be fixed to the second end $\mathbf{7}_2$ of the sleeve 7 by any type of fixing known in the state of the art, such as screwing or bayonet type fixing. Preferably, the knob 8 is screwed to the sleeve 7 by its second end $\mathbf{7}_2$ thanks to the presence of threading or tapping (not represented in the figures).

The knob 8 may have a cylindrical shape, as illustrated in FIG. 1. This example is not limiting and another form could be envisaged.

Whatever the embodiment of the invention, the handle 3 comprises a control unit 9 controlling the lighting source(s) 4 lighting the tubular blade 2. The control unit 9 allows controlling the lighting source(s) 4 and, when appropriate, a loudspeaker present in the handle 3.

Removable Fixing System

Figure 2A:
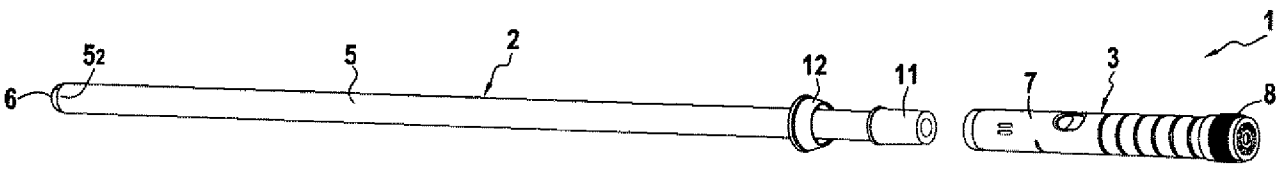
FIGS. 2A and 2B are a perspective view of the mounting of the system for removably fixing the blade on the handle of a light-sabre type accessory according to the first embodiment of the invention.
Figure 2B:
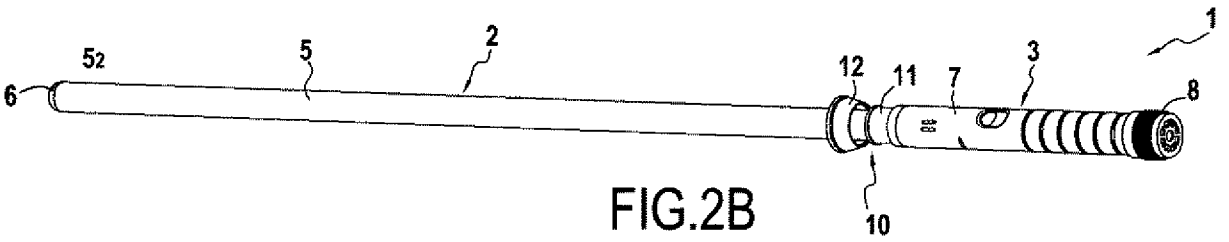

According to a first embodiment of the invention illustrated in FIGS. 2A and 2B, the light-sabre type accessory 1 comprises a system for removably fixing 10 the tubular blade 2 on the handle 3. The removable nature of the fixing system 10 facilitates the mounting and dismounting of the tubular blade 2 on the handle 3 because no tools are needed. In addition, the removable fixing system 10 according to this embodiment is robust and allows as many mountings and dismountings as desired of the tubular blade 2 on the handle 3.

According to this embodiment, the removable fixing system 10 is composed of a mouthpiece 11 and of a clamping ring 12.

Figure 3:
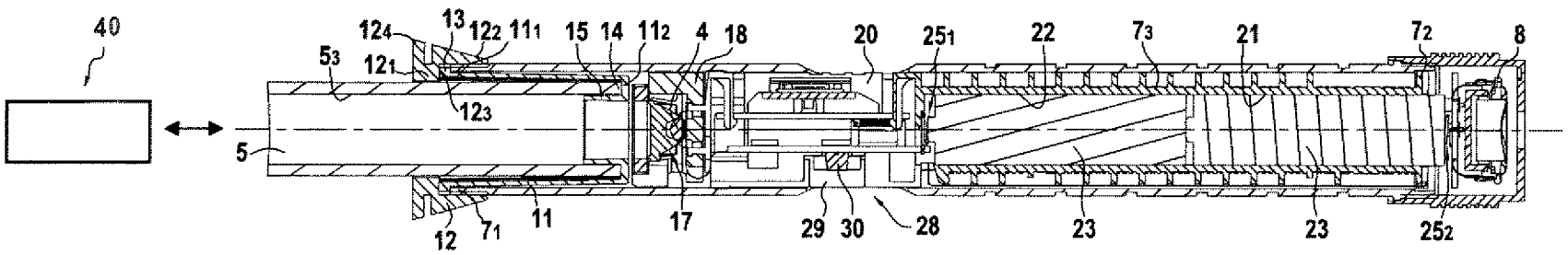
FIG. 3 is a sectional view of a light-sabre type accessory according to the invention.

The mouthpiece 11 is fitted to the proximal end $\mathbf{5}_1$ of the tube 5 on the outside of the mouthpiece. More specifically, as illustrated in FIG. 3, the mouthpiece 11 has a first end $\mathbf{11}_1$ provided with a shoulder 13 directed outwardly. The shoulder 13 abuts against the first end $\mathbf{7}_1$ of the sleeve 7, so that the first end $\mathbf{11}_1$ of the mouthpiece 11 and the first end $\mathbf{7}_1$ of the sleeve are adjacent. Thus, when the shoulder 13 of the mouthpiece 11 is in abutment on the first end $\mathbf{7}_1$ of the sleeve 7, the mouthpiece 11 and consequently a portion of the tubular blade 2 is engaged inside the sleeve 7. More specifically, the mouthpiece 11 is engaged up to its shoulder, inside a well 7*p* delimited inside the sleeve 7 between the first end $\mathbf{7}_1$ of the sleeve 7 and the lighting source 4. This well 7*p* is open on one side, outwardly from the first end $\mathbf{7}_1$ of the sleeve and on the other side, in the direction of the lighting source 4. The mouthpiece 11 is fixed to the tube 5, preferably by bonding. The mouthpiece 11 is fixed to the tube 5 by a complete permanent or non-dismountable connection.

Preferably, according to this first embodiment, the mouthpiece 11 further includes a second end $\mathbf{11}_2$, or free end, including an abutment bottom 14 for the tube 5 which is extended at right angle by a return 15 inside the tube 5. This profile of the mouthpiece 11 allows a holding in position of the tube 5, and possibly of the light diffusion and conduction system, which is schematically represented by the reference numeral 40 in FIG. 3, when it is present, even when the tubular blade 2 is mounted or dismounted from the handle 3, and even in the event of impact experienced by the light-sabre type accessory 1. Indeed, the tube 5 is provided, from its free end and over a determined length, externally with the mouthpiece 11 and internally with the return 15. When the tubular blade 2 is mounted on the handle 3, the second end $\mathbf{11}_2$ of the mouthpiece 11 is located in the vicinity of the lighting source 4.

When mounting the tubular blade 2 on the handle 3 by means of the removable fixing system 10 according to the first embodiment of the invention illustrated in FIGS. 2A and 2B, the clamping ring 12 is engaged from the distal end $\mathbf{5}_2$ of the tube 5 to be fitted onto the mouthpiece 11 and fixed to the first end $\mathbf{7}_1$ of the sleeve 7. The mouthpiece 11 is then fixed in translation by the clamping ring 12.

More specifically, the clamping ring 12 includes a first end $\mathbf{12}_1$, a second end 122 and an abutment surface $\mathbf{12}_3$. The clamping ring 12 is then fitted onto the mouthpiece 11 so that the abutment surface $\mathbf{12}_3$ of the clamping ring 12 abuts from the shoulder 13 of the mouthpiece 11. The shoulder 13 of the mouthpiece 11 is then in contact on one side with the abutment surface $\mathbf{12}_3$ of the clamping ring 12 and on the other side with the first end $\mathbf{7}_1$ of the sleeve 7. Thus, the shoulder 13 of the mouthpiece 11 allows blocking in translation the tube 5 relative to the sleeve 7.

Preferably, the clamping ring 12 is fixed on the sleeve 7 by screwing or by engagement in studs, by abutting from the shoulder 13 of the mouthpiece 11, which then allows making the sleeve 7 and the clamping ring 12 secured to each other.

According to the embodiment illustrated in FIGS. 2A, 2B and 3, the clamping ring 12 is screwed to the first end $\mathbf{7}_1$ of the sleeve 7 while abutting from the shoulder 13 of the mouthpiece 11. The clamping ring 12 is screwed on the first end $\mathbf{7}_1$ of the sleeve 7 by means of a threading or a tapping.

According to one embodiment not illustrated, the clamping ring 12 is fixed by a bayonet-type fixing system to the first end $\mathbf{7}_1$ of the sleeve 7 while abutting from the shoulder 13 of the mouthpiece 11. According to this embodiment, two openings located on the clamping ring 12 are each engaged in a stud located on the sleeve 7.

Preferably, the clamping ring 12 is screwed on the first end $\mathbf{7}_1$ of the sleeve 7 by means of a threading or a tapping through one of its ends.

During the dismounting of the tubular blade 2, the clamping ring is unscrewed.

According to this embodiment, the mounting and dismounting of the tubular blade 2 on the handle 3 by means of the removable fixing system 10 is easy, and does not require any tools.

In the exemplary embodiment illustrated in FIG. 3, the clamping ring 12 includes a protruding portion $\mathbf{12}_4$ at its free end, in the form of a frustoconical portion: depending on the profile and the chosen dimensions of the protruding portion $\mathbf{12}_4$ of the clamping ring 12, the latter can advantageously also serve as a blade guard.

Control Unit

According to a second embodiment of the invention illustrated in FIGS. 3 to 7, the control unit 9 comprises at least one lighting source 4, and preferably a single lighting source 4 and a cylindrical support 16.

As illustrated in FIG. 3, the control unit 9 comprises a lighting source 4. An optical element 17 abutting from the cylindrical support 16 promotes the conduction of light in the direction of the tubular blade 2. For example, it may have a rounded profile directed towards the tube 5.

As examples of lighting sources 4 suitable in the framework of the invention, mention may be made of the LEDs which are commonly used in the field. However, the LEDs have the disadvantage of generating heat when they are used. Consequently, the lighting source 4 is advantageously laterally surrounded by a heat-conducting element 18, that is to say a radiator, in order to dissipate it, for example made of aluminum.

According to the second embodiment illustrated in FIGS. 3 to 7, the control unit 9 comprises a cylindrical support 16 formed by two half-shells $\mathbf{16}_1$ and $\mathbf{16}_2$ assembled together by snap-fastening. This example is not limiting, and it could for example be envisaged to use a cylindrical support 16 formed of one part in two articulated portions and closed by snap-fastening or by bonding, or of two or more parts closed by bonding or by snap-fastening.

According to this second embodiment of the invention, the cylindrical support 16 cooperates with the inner surface $\mathbf{7}_3$ of the sleeve 7, that is to say the cylindrical support 16 matches the inner surface $\mathbf{7}_3$ of the sleeve 7. Thus, the cylindrical support 16 does not move transversely in the sleeve 7, and particularly in the event of impact. In addition, according to one advantageous embodiment, a blocking system 19 allows blocking in translation and in rotation the cylindrical support 16 in the sleeve 7. As an example of a blocking system 19, the sleeve 7 may include lugs $\mathbf{19}_1$ able to be housed in complementary holes $\mathbf{19}_2$ formed in the sleeve 7. Other blocking systems known to those skilled in the art can be used in the framework of the invention.

According to the second embodiment of the invention, the cylindrical support 16 is formed of a casing 20 from which a tubular shank 21 extends. The tubular shank 21 is then in the extension of the casing 20.

According to this second embodiment, the tubular shank 21 internally delimits a receiving housing 22 open at the end opposite to the casing 20, which allows receiving a battery, and particularly cells 23, necessary for the operation of the light-sabre type accessory 1. Both ends of the housing 22 are connected to a power supply circuit via terminals 25, as detailed below. In the context of the invention, this housing 22 is large enough to receive several cells 23 placed end-to-end, which guarantees good battery life for the light-sabre type accessory 1.

According to this second embodiment, the cylindrical support 16 allows holding in position an electronic system 26. To this end, the casing 20 of the cylindrical support 16 comprises an assembly structure 27 which allows the holding in position of the electronic system 26. Preferably, the assembly structure 27 is a snap-fastening system.

According to the second embodiment of the invention, the electronic system 26 comprises an electronic board supporting a control circuit controlling the lighting source 4.

According to the second embodiment of the invention, the electronic system 26 comprises a control button 28 controlling at least one lighting source 4. The control button 28 is supported by the control unit 9 and controls the operation of the lighting source 4.

The control button 28 is engaged in a passage hole $\mathbf{16}_3$ of the cylindrical support 16. Thus, the control button 28 is guided in translation by the cylindrical support 16, through the passage hole $\mathbf{16}_3$.

In the non-active position, the control button 28 is preferably flush, that is to say not protruding, with the external surface of the cylindrical support 16, so as to be able to easily insert the control unit 9 into the sleeve 7, without tools.

Alternatively, it is also possible that the control button 28 protrudes from the cylindrical support 16 in the non-active position. In this case, the control button 28 has a retraction capacity allowing easy insertion of the control unit 9 into the sleeve 7.

According to this second embodiment, the control button 28 comprises a key 29 on which the user can exert a pressure, and a switching element 30 placed below the key 29.

The key 29 includes a protruding crown $\mathbf{29}_1$ at its base to serve as an abutment. Thus, the key 29 is held in extended position by the cylindrical support 16, the protruding crown $\mathbf{29}_1$ coming into contact with the cylindrical support 16. In the illustrated example, the key 29 has a rounded shape. This shape is however not limiting.

The switching element 30 comprises contact pads 31 directed inwardly of the cylindrical support. In the example illustrated, the switching element 30 comprises three contact pads, but this example is not limiting.

When a pressure is exerted on the key 29, the latter bears on the switching element 30. Thus, this pressure is transmitted to the switching element 30, and therefore to the contact pads 31 which allow establishing an electrical contact with the electronic system 26 supporting a control circuit controlling the lighting source 4.

In addition, according to this embodiment, the sleeve 7 includes an orifice 32 formed so as to be able to be positioned facing the passage hole $\mathbf{16}_3$ and the control button 28 during the mounting. Thus, the control button 28 is guided in translation in the cylindrical support 16, and is accessible to the user via the orifice 32.

According to this second embodiment of the invention, the electronic system 26 is also equipped with a gyroscope (not represented in the figures) and with an accelerometer (not represented in the figures). Thus, the electronic system 26 is capable of detecting movements made with the light-sabre type accessory 1 according to the invention.

Advantageously, the light-sabre type accessory 1 according to the invention emits sounds and/or modifies the lighting of the tubular blade 2 based on the detected movements. To this end, the control button 28 is connected, via the contact pads 31, on one side, to the control circuit controlling the lighting source 4, and on the other side, when the light-sabre comprises a loudspeaker 33, to the control circuit controlling the loudspeaker 33. In this case, the control button 28 controls the operation of the lighting source 4 and/or of the loudspeaker 33. In the illustrated embodiment, the knob 8 includes a loudspeaker 33 and an electronic board supporting a control circuit controlling the loudspeaker 33.

According to the second embodiment of the invention, the electronic system 26 can be in the form of several electronic boards $\mathbf{34}_1$, $\mathbf{34}_2$, $\mathbf{34}_3$ superimposed and held in position in the cylindrical support 16, and more specifically in the casing 20, thanks to the assembly structure 27. According to the embodiment illustrated in FIGS. 5, 6 and 7, the electronic system 26 is in the form of three electronic boards $\mathbf{34}_1$, $\mathbf{34}_2$ and $\mathbf{34}_3$ superimposed in the casing 20. It could nevertheless be envisaged to superimpose a different number of electronic boards. Their number depends in particular on the volume required for the housing 22 for receiving the cells 23 and on the dimension of the cylindrical support 16.

According to this illustrated embodiment, the electronic system 26 may comprise an electronic motherboard $\mathbf{34}_1$ which is fixed by an assembly structure 27, for example by snap-fastening, to the cylindrical support 16. The electronic motherboard $\mathbf{34}_1$ also includes a connector 35 allowing its assembly with a complementary connector 36 carried by an electronic board $\mathbf{34}_2$ supporting the control button. This assembly of the electronic motherboard $\mathbf{34}_1$ and of the electronic board $\mathbf{34}_2$ supporting the control button allows not only an electrical contact but also the holding in position of this electronic board.

This assembly of the different superimposed electronic boards has the advantage of allowing easy mounting, in particular due to the absence of electric wires. This assembly is also robust over time, and ensures satisfactory electrical contact. The different electronic boards $\mathbf{34}_1$, $\mathbf{34}_2$, $\mathbf{34}_3$ are well held in position, so that they are not damaged in the event of impact experienced by the light-sabre type accessory 1. In addition, this stack of the different electronic boards $\mathbf{34}_1$, $\mathbf{34}_2$, $\mathbf{34}_3$ allows a space saving, allowing to have a housing 22 for receiving the larger cells 23.

Although not illustrated, the electronic system 26 may take the form of a single electronic board supporting a control button 28, a control circuit controlling the lighting source(s) 4, a gyroscope and an accelerometer. This embodiment is however not preferred for dimensioning reasons.

According to the second embodiment of the invention, the control unit 9 also includes an electric power supply circuit.

Figure 4:
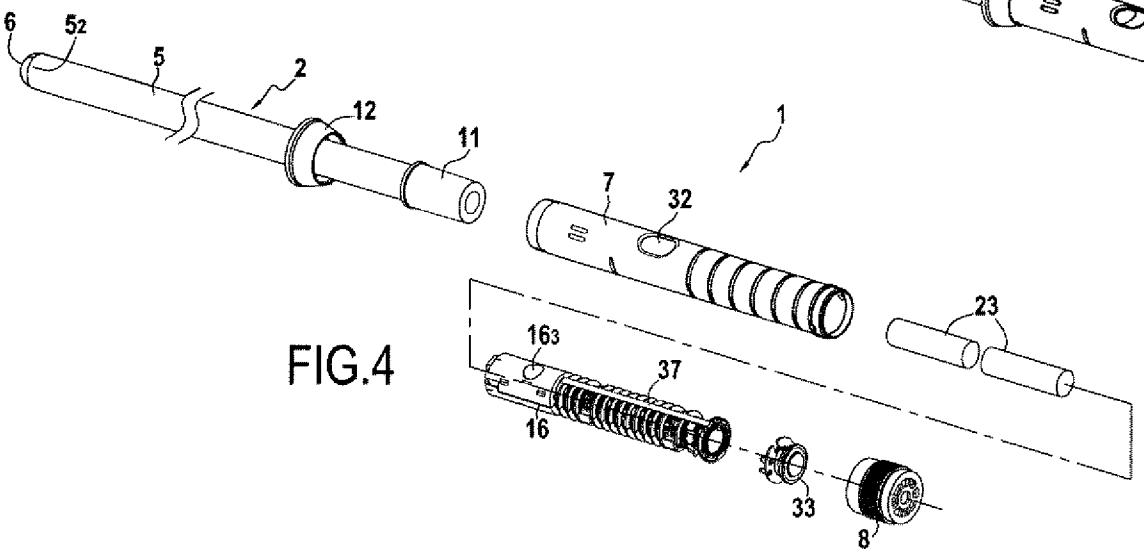
FIG. 4 is an exploded perspective view of a light-sabre type accessory according to the invention.
Figure 5:
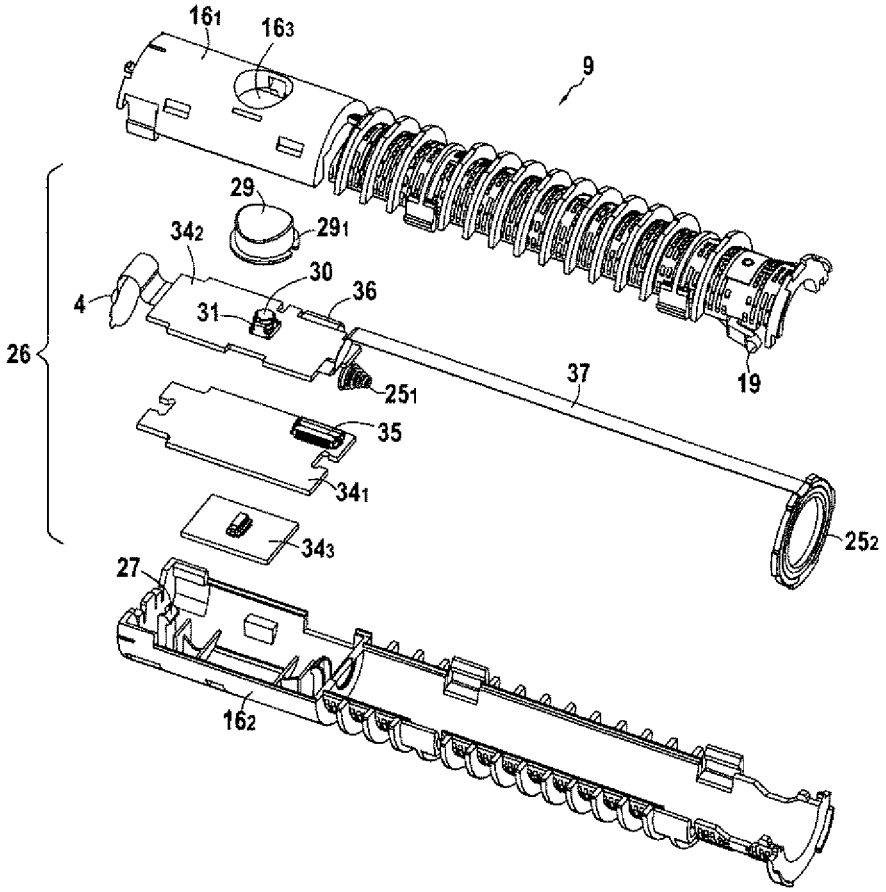
FIG. 5 is an exploded perspective view of a stack of the different elements of a control unit of a light-sabre type accessory according to the invention.

This electric power supply circuit comprises the cells 23, a connection strip 37 carried by the outside of the tubular shank 21 of the cylindrical support 16 and extending from one end to the other of the control unit 9, a first terminal $\mathbf{25}_1$ at the bottom of the housing 22 of the tubular shank 21 (positive terminal) and a second terminal $\mathbf{25}_2$ at the opposite end (negative terminal), circular in the embodiment illustrated in FIGS. 4 and 5, to establish an electrical contact with the cells 23. A contact pad 31 of the control button 28 allows powering the circuit when a pressure is exerted on the key 29 of the control button 28. This contact pad 31 acts as a switch. Indeed, when a pressure is exerted on the button 29 of the control button 28, the contact pads 31 establish an electrical contact with the supply circuit and with the electronic system 26.

For the case where the sleeve 7 is perforated, the connection strip 37 is visible from the outside of the handle 3.

Communication with a Remotely Communicating Device

According to a third embodiment of the invention, the electronic system 26 includes a Bluetooth emitter component 39. Such a component allows communicating with a remotely communicating device, such as a speaker or an audio headset, or even a smartphone or a tablet. Thus, according to this particular embodiment, it is possible to emit the sounds through the remotely communicating device, instead of the loudspeaker 33 present in the knob 8, based on the movements of the light-sabre type accessory 1. This embodiment also allows communicating with a smartphone or a tablet for example, via a dedicated application, then allowing the user to choose and modify the emitted sounds and the lighting of the tubular blade 2.

According to this third embodiment, the Bluetooth emitter component 39 can be a "Classic Bluetooth" type component which allows an emission of the sounds on a remotely communicating audio peripheral (a speaker or a headset for example), or a "Bluetooth Low Energy" type component which allows a two-way exchange (emitter and receiver component) with a smartphone or a tablet for example, or a "Classic Bluetooth" type component and a "Bluetooth Low Energy" type component, or a "Dual Mode" type component which allows both a "Classic Bluetooth" type exchange and a "Bluetooth Low Energy" type exchange (emitter and receiver component) not only to emit sounds on a remotely communicating audio peripheral but also to communicate with a remotely communicating device such as a smartphone or a tablet far example (emitter and receiver component). According to a preferred embodiment, the Bluetooth emitter component is a "Dual Mode" type component, then allowing the emission of the sounds on a remotely communicating audio peripheral and the two-way communication with a remotely communicating device, such as "a smartphone or a tablet, allowing modifying the sounds and/or the lighting. According to this embodiment, the communication with the audio peripheral on the one hand and with the smartphone or the tablet on the other hand, can take place simultaneously or one after the other. Advantageously, this Bluetooth emitter component 39 can be carried by an electronic board. Preferably, the Bluetooth emitter component 39 is positioned so as to be in the vicinity of the inner surface $\mathbf{7}_3$ of the sleeve 7.

Advantageously, according to this third embodiment, the sleeve 7 comprises an aperture 40 facing the Bluetooth emitter component 39. Such an aperture 40 is advantageous because it facilitates the passage of the waves. In this case, it is preferable that the Bluetooth emitter component 39 is positioned as close as possible to this aperture 40.

Figure 6:
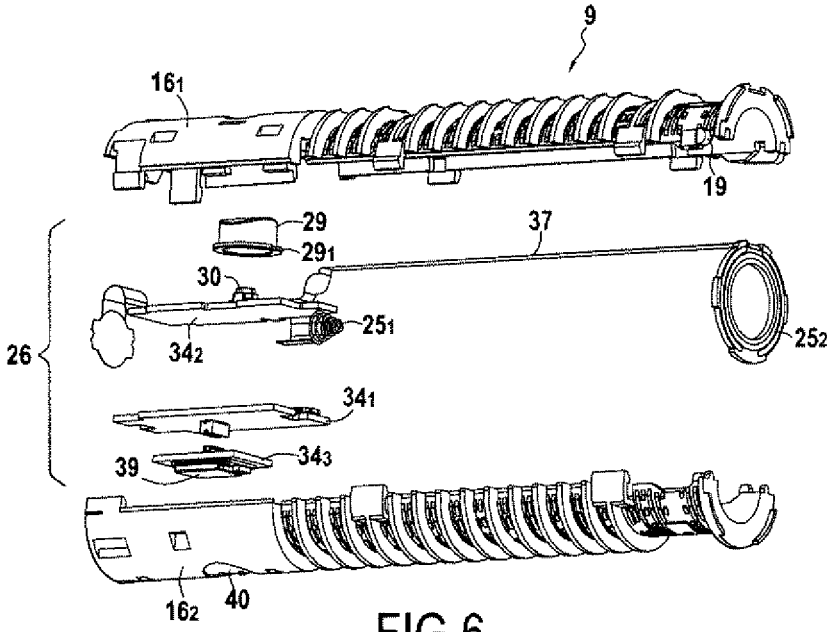
FIG. 6 is an exploded perspective view of a stack of the different elements of a control unit of a light-sabre type accessory according to the invention.

According to one advantageous embodiment illustrated in FIGS. 5 and 6, the aperture 40 is positioned diametrically opposite to the orifice 32 formed in the sleeve 7.

Figure 7:
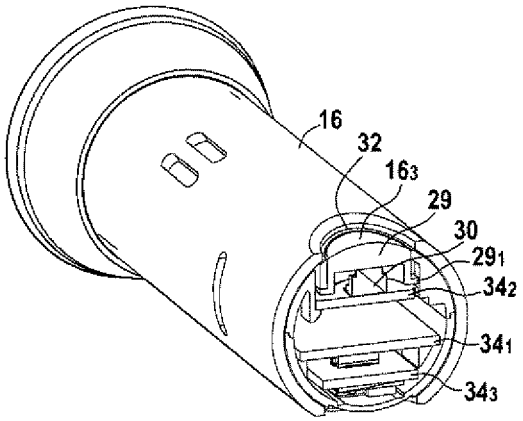
FIG. 7 is a perspective view of a casing of a light-sabre type accessory according to the invention.

When the electronic system 26 is in the form of several electronic boards, one of them may be an electronic board $\mathbf{34}_3$ supporting the Bluetooth emitter component 39, as illustrated in FIGS. 5 to 7.

Although not illustrated, the electronic system 26 may take the form of a single electronic board supporting a control button 28, a control circuit controlling the lighting source(s) 4, a gyroscope and an accelerometer, and a Bluetooth emitter component 39. This embodiment is however not preferred for space requirement reasons.

Although not preferred, the Bluetooth emitter component according to this third embodiment could be replaced by another emitter, and possibly emitter and receiver, component allowing communication with a remotely communicating device, such as a WIFI component.

In the framework of the invention, a light-sabre type accessory 1 according to the invention can optionally combine the embodiments previously described on the removable fixing system 10, on the control unit 9 and on the communication with a remotely communicating device.

For example, the invention concerns a light-sabre type accessory 1 having the removable fixing system 10 according to the first embodiment of the invention, a control unit known in the state of the art, and not including Bluetooth emitter component.

For example, the invention concerns a light-sabre type accessory 1 having a control unit 9 according to the second embodiment of the invention, a system for fixing the tubular blade 2 on the handle 3 known in the state of art, and not including a Bluetooth emitter component.

For example, the invention concerns a light-sabre type accessory 1 having a removable fixing system and a control unit known in the state of the art, and comprising a Bluetooth emitter component 39 according to the third embodiment of the invention.

For example, the invention concerns a light-sabre type accessory 1 having the removable fixing system 10 according to the first embodiment of the invention, a control unit known in the state of the art, and comprises a Bluetooth emitter component 39 according to the third embodiment of the invention.

For example, the invention concerns a light-sabre type accessory 1 having a control unit 9 according to the second embodiment of the invention, a system for fixing the tubular blade 2 on the handle 3 known in the state of art, and comprises a Bluetooth emitter component 39 according to the third embodiment of the invention.

For example, the invention concerns a light-sabre type accessory 1 having the removable fixing system 10 according to the first embodiment of the invention, a control unit 9 according to the second embodiment of the invention, and comprising no Bluetooth emitter component.

Preferably, the invention concerns a light-sabre type accessory 1 having the removable fixing system 10 according to the first embodiment of the invention, a control unit 9 according to the second embodiment of the invention, and comprises a Bluetooth emitter component 39 according to the third embodiment of the invention.

According to this preferred embodiment illustrated in FIGS. 5, 6 and 7, the electronic system 26 is in the form of several superimposed electronic boards $\mathbf{34}_1$, $\mathbf{34}_2$, $\mathbf{34}_3$, and particularly three superimposed electronic boards $\mathbf{34}_1$, $\mathbf{34}_2$ and $\mathbf{34}_3$ in the example illustrated, in the casing 20: an electronic motherboard $\mathbf{34}_1$ equipped with a gyroscope and an accelerometer, an electronic board $34_2$ supporting a control button 28, and an electronic board $34_3$ including a Bluetooth emitter component 39. The electronic motherboard $34_1$ is fixed by snap-fastening to the cylindrical support 16. The electronic motherboard $34_1$ also includes a connector 35 allowing its assembly with a complementary connector 36 carried by the electronic board $34_2$ supporting the control button 28. This assembly of the electronic motherboard $34_1$ and of the electronic board $34_2$ supporting the control button allows not only an electrical contact but also the holding in position of this electronic board. In the illustrated exemplary embodiment, the control button 28 comprises three contact pads 31, allowing respectively establishing an electrical contact, when the control button 28 is actuated, with the electronic motherboard $34_1$, with the control circuit controlling the lighting source(s) 4, and with a terminal 25 of the power supply circuit. Finally, the electronic board $34_3$ including the Bluetooth emitter component 39 is assembled to the electronic motherboard $34_1$ by snap-fastening. According to this embodiment, the electronic boards are advantageously assembled together before fixing the electronic motherboard $34_1$ to the cylindrical support 16. The stacking order of the different electronic boards is given by way of example, but is not limiting. Nevertheless, the electronic board $34_3$ including the Bluetooth emitter component 39 is preferably positioned as close as possible to the inner surface $7_3$ of the sleeve 7, and particularly facing the aperture 40 formed in the sleeve 7, to facilitate the passage of the waves.

The invention claimed is:

1. A light-sabre type accessory (1) comprising:

a tubular blade (2) comprising a tube (5) including a proximal end ($5_1$) and a distal end ($5_2$);

a handle (3) comprising a sleeve (7) with a first end ($7_1$) and a second end ($7_2$), into which is inserted a control unit (9) controlling at least one lighting source (4) lighting the tubular blade (2), and a system for removably fixing (10) the tubular blade (2) on the handle (3) through its proximal end ($5_1$), composed of a mouthpiece (11) fitted to the proximal end ($5_1$) of the tube (5) and a clamping ring (12) engaged to be fitted onto the mouthpiece (11) and fixed to the first end ($7_1$) of the sleeve (7), characterized in that:

the mouthpiece (11) is fixed on outside of the tube (5) and includes a shoulder (13) able to abut against the first end ($7_1$) of the sleeve;

the sleeve (7) includes from its first end ($7_1$), a well (*7p*) in which the mouthpiece is engaged up to its shoulder (13);

the clamping ring (12) is engaged from the distal end ($5_2$) of the tube (5) to be fitted onto the mouthpiece (11); and the mouthpiece (11) includes at its free end ($11_2$) an abutment bottom (14) for the tube (5) extended at right angle by a return (15) inserted inside the tube (5), allowing holding in position the tube (5).

2. The light-sabre type accessory (1) according to claim 1, wherein the return (15) of the mouthpiece (11) ensures the holding of a light diffusion and conduction system inserted inside the tube (5).

3. The light-sabre type accessory (1) according to claim 1, wherein the clamping ring (12) includes a protruding portion ($12_4$) relative to the sleeve (7) whose profile is formed to serve as a blade guard.

4. The light-sabre type accessory (1) according to claim 1, wherein the control unit (9) comprises a cylindrical support (16) cooperating with the inner surface ($7_3$) of the sleeve (7), the cylindrical support (16) holding in position an electronic system (26) provided with a control button (28) controlling the lighting source (4), said control button (28) being guided in translation by the cylindrical support (16) and positioned facing an orifice (32) formed in the sleeve (7).

5. The light-sabre type accessory (1) according to claim 4, comprising a system for blocking (19) in translation and in rotation the cylindrical support (16) in the sleeve (7).

6. The light-sabre type accessory (1) according to claim 4, wherein the cylindrical support (16) is composed of a casing (20) provided with an assembly structure (27) to hold in position the electronic system (26), and from which extends a tubular shank (21) internally delimiting a receiving housing (22), open at the end opposite to the casing (20), to receive cells (23).

7. The light-sabre type accessory (1) according to claim 6, wherein the electronic system (26) is equipped with a gyroscope and an accelerometer to detect movements of the handle (3), the control button (28) being connected to a control circuit controlling the lighting source (4) to activate the lighting source (4) based on the detected movements.

8. The light-sabre type accessory (1) according to claim 6, including an electric power supply circuit comprising a connection strip (37) carried by the outside of the tubular shank (21) and extending from one end to the other of the control unit (9), a first terminal ($25_1$) at the bottom of the housing (22) of the tubular shank (21) and a second terminal ($25_2$) at the opposite end, to establish an electrical contact with the cells (23).

9. The light-sabre type accessory (1) according to claim 4, wherein the electronic system (26) is in the form of several electronic boards ($34_1$, $34_2$, $34_3$) mounted in a superimposed manner.

10. The light-sabre type accessory (1) according to claim 9, wherein the electronic system (26) includes an electronic motherboard ($34_1$) equipped with the gyroscope and the accelerometer, fixed by snap-fastening to the cylindrical support (16), on one side supporting a connector (35) assembled with a complementary connector (36) carried by an electronic board ($34_2$) supporting the control button (28), and on the other side assembled by snap-fastening to an electronic board ($34_3$) including the Bluetooth emitter component (39).

11. The light-sabre type accessory (1) according to claim 4, wherein a knob (8) fixed to the second end ($7_2$) of the sleeve (7) comprises a loudspeaker (33) and an electronic board supporting a control circuit controlling the loudspeaker (33).

12. The light-sabre type accessory (1) according to claim 11, wherein the electronic system (26) includes a Bluetooth emitter component (39) allowing communication with a remotely communicating device.

13. The light-sabre type accessory (1) according to claim 10, wherein an aperture (40) is formed in the sleeve (7) facing the Bluetooth emitter component (39) to promote the passage of waves.

14. The light-sabre type accessory (1) according to claim 11, wherein the control button (28) controls the operation of the loudspeaker (33).

* * * * *